US011028541B2

(12) United States Patent
Till

(10) Patent No.: US 11,028,541 B2
(45) Date of Patent: Jun. 8, 2021

(54) MODULAR BRIDGE SYSTEM

(71) Applicant: Richard Carl Till, Roberts Creek (CA)

(72) Inventor: Richard Carl Till, Roberts Creek (CA)

( * ) Notice: Subject to any disclaimer, the term of this patent is extended or adjusted under 35 U.S.C. 154(b) by 0 days.

(21) Appl. No.: 16/711,261

(22) Filed: Dec. 11, 2019

(65) Prior Publication Data

US 2020/0199830 A1 Jun. 25, 2020

Related U.S. Application Data

(60) Provisional application No. 62/784,392, filed on Dec. 22, 2018.

(51) Int. Cl.
*E01D 15/133* (2006.01)
*E01D 101/34* (2006.01)

(52) U.S. Cl.
CPC ..... *E01D 15/133* (2013.01); *E01D 2101/34* (2013.01)

(58) Field of Classification Search
CPC ..... E01D 15/133; E01D 15/2101–34; E01D 2101/34
USPC ..... 14/69.5–72.5, 2.4
See application file for complete search history.

(56) References Cited

U.S. PATENT DOCUMENTS 6,055,692 A * 5/2000 Pell ..... B64F 1/305 14/71.5
6,347,424 B1 * 2/2002 Vatne ..... B63B 27/14 14/69.5
6,678,910 B2 * 1/2004 Smith ..... B64F 1/305 14/69.5
6,955,134 B2 * 10/2005 Prins ..... B63B 21/00 114/230.14
7,069,611 B2 * 7/2006 Larson ..... B64F 1/30 14/71.1
8,127,388 B2 * 3/2012 Watchorn ..... B63B 27/143 14/2.6
8,266,750 B2 * 9/2012 Peterson ..... B64F 1/305 14/71.5
9,284,066 B2 * 3/2016 Larson ..... B64F 1/305
9,932,751 B2 * 4/2018 Gutkuhn ..... E04H 15/38
2015/0191258 A1 * 7/2015 Gutkuhn ..... B64F 1/30 14/69.5
2016/0251858 A1 * 9/2016 Suggate ..... E04F 11/002 14/69.5

* cited by examiner

*Primary Examiner* — Raymond W Addie
(74) *Attorney, Agent, or Firm* — Gulf Coast Intellectual Propery Group

(57) ABSTRACT

A portable modular bridge system that is configured to be easily assembled, disassembled and transported so as to facilitate the transportation of the bridge system to a remote location for installation. The bridge system of the present invention includes a deck member having a first end and a second end. The deck member is operably coupled to a two support members wherein the support members are located at opposing ends of the deck member. The support members a are formed from a plurality of structural members to create an elongated polygon shape having a central opening configured to have a human pass therethrough. A pair of side rails are structurally coupled to the bottom portion of the two support members. A top frame member is superposed the top portion of the two support members and is operably coupled thereto. A lateral stability component is further included.

12 Claims, 4 Drawing Sheets

MODULAR BRIDGE SYSTEM

PRIORITY UNDER 35 U.S.C SECTION 119(E) & 37 C.F.R. SECTION 1.78

This nonprovisional application claims priority based upon the following prior U.S. Provisional Patent Application entitled: Modular Bridge System, Application No. 62/784,392 filed Dec. 22, 2018, in the name of Richard Carl Till, which is hereby incorporated by reference for all purposes.

FIELD OF THE INVENTION

The present invention relates generally to bridges, more specifically but not by way of limitation, a modular bridge system that is primarily comprised of three modular components that are configured to be easily transported and modularly linked in order to provide a temporary bridge for traversing a ravine or similar geographic feature.

BACKGROUND

Much of the earth's surface is undeveloped wild terrain. The terrain varies greatly and ranges from features including flat plains to mountainous regions. Mountainous regions provide unique challenges for an individual when the need arises to traverse thereacross. Remote areas are often undeveloped to the point wherein the area will have limited to no roads. Various reasons precipitate the need to traverse through these terrains and can range from a rescue operation to a recreational purpose such as but not limited to a running or biking event. Regardless of the purpose, it can often occur that the terrain may present a unique challenge at certain points along the route. Geographic features such as but not limited to gullies and ravines present a challenging obstacle for any individual trying to traverse across. It can often be inconvenient to be descend down the ravine or gully and then ascend up the opposing side. A maneuver such as the aforementioned is undesirable if time is of the essence in a rescue operation. Likewise, for a recreational event such as an outdoor run, such as maneuver can present unwanted risks to the participants of the event.

Existing technology available to assist in the crossing of ravines or gullies come with many challenges. One challenge is the transportation logistics of the bridge itself to the location. As bridges must be constructed to support certain loads with minimal sway and deflection, their construction often results in larger pieces, which are difficult to transport and install. Additionally, due to structural requirements, bridges may not be built from lighter weight materials and as such require additional manpower or equipment to facilitate the installation thereof.

It is intended within the scope of the present invention to provide a modular bridge system that is manufactured from a lightweight strong material wherein the present invention is configured to be easily transported and assembled at the desired location.

SUMMARY OF THE INVENTION

It is the object of the present invention to provide a modular bridge system that is configured to be easily transported and installed at a desired location wherein the modular bridge system comprises three primary components that are assembled at the installation site to create a bridge.

Another object of the present invention is to provide a modular bridge system that is configured to be installed across a geographic feature such as but not limited to a gully wherein one of the three primary modules is a deck module and wherein the deck module is operable to provide a surface for user to traverse across.

A further object of the present invention is to provide a modular bridge system that is configured to be easily transported and installed at a desired location wherein deck module is manufactured from aluminum and in a preferred embodiment includes non-skid decking.

Still another object of the present invention is to provide a modular bridge system that is configured to be installed across a geographic feature such as but not limited to a gully wherein a second of the three primary modules are support modules, wherein the support modules are polygon in form and vertical in orientation.

An additional object of the present invention is to provide a modular bridge system that is configured to be easily transported and installed at a desired location wherein the support modules include a plurality of support members welded in the aforementioned shape and are manufactured from aluminum.

Yet a further object of the present invention is to provide a modular bridge system that is configured to be installed across a geographic feature such as but not limited to a gully wherein the support modules utilize no butt-welds on the linear members thereof.

Another object of the present invention is to provide a modular bridge system that is configured to be easily transported and installed at a desired location wherein the support members of the support modules are arranged in a duplicate pattern having intersecting supports therebetween.

An alternate object of the present invention is to provide a modular bridge system that is configured to be installed across a geographic feature such as but not limited to a gully wherein the deck module is superposed the bottom support members of the support module subsequent assembly.

Still a further object of the present invention is to provide a modular bridge system that is configured to be easily transported and installed at a desired location wherein the third primary module are side trusses, wherein the side trusses function as side railings and structural support for the assembled bridge.

An additional object of the present invention is to provide a modular bridge system that is configured to be installed across a geographic feature such as but not limited to a gully wherein the side trusses include upper and lower support members and further have support members operably coupled therebetween.

A further object of the present invention is to provide a modular bridge system that is configured to be easily transported and installed at a desired location wherein the present invention further includes outrigger support members that are configured to operably couple to the bottom of the support modules and extend outward therefrom.

An alternative objective of the present invention is to provide a modular bridge system that is configured to be installed across a geographic feature such as but not limited to a gully that further includes support members operably coupled intermediate the outrigger support members and the midpoint of the support module.

A further object of the present invention is to provide a modular bridge system that is configured to be easily transported and installed at a desired location wherein the modular bridge of the present invention is assembled utilizing a ubiquitous fastener.

An alternate object of the present invention is to provide a modular bridge system that is configured to be installed across a geographic feature such as but not limited to a gully wherein in a preferred embodiment the disassembled modules are of size to be transported in a conventional four by eight truck bed.

Another object of the present invention is to provide a modular bridge system that is configured to be easily transported and installed at a desired location wherein the outrigger support members are secured to connector plates present on the support modules.

A further object of the present invention is to provide a modular bridge system that is configured to be installed across a geographic feature such as but not limited to a gully wherein a preferred embodiment of the present invention is manufactured from T6 aluminum.

An alternative object of the present invention is to provide a modular bridge system that is configured to be easily transported and installed at a desired location wherein the modular bridge of the present invention can be installed with or without the outrigger support members.

An additional object of the present invention is to provide a modular bridge system that is configured to be installed across a geographic feature such as but not limited to a gully wherein the deck modules and side trusses can be provided in alternate sizes.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
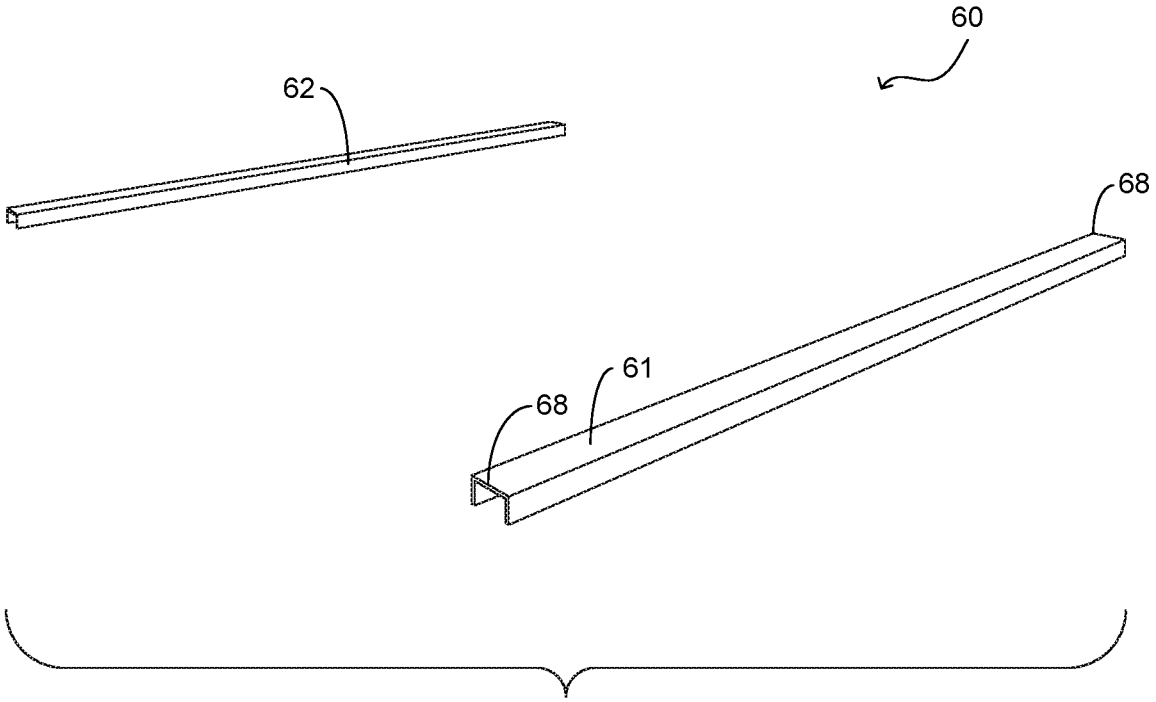
FIG. 1 is a detailed view of the base members of the lateral stability component.
Figure 2:
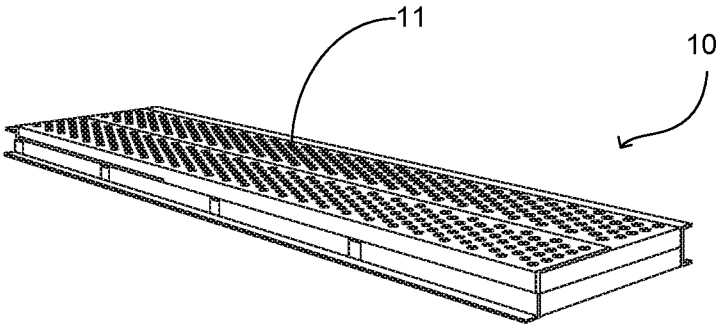
FIG. 2 is a detailed view of the deck member of the present invention.
Figure 3:
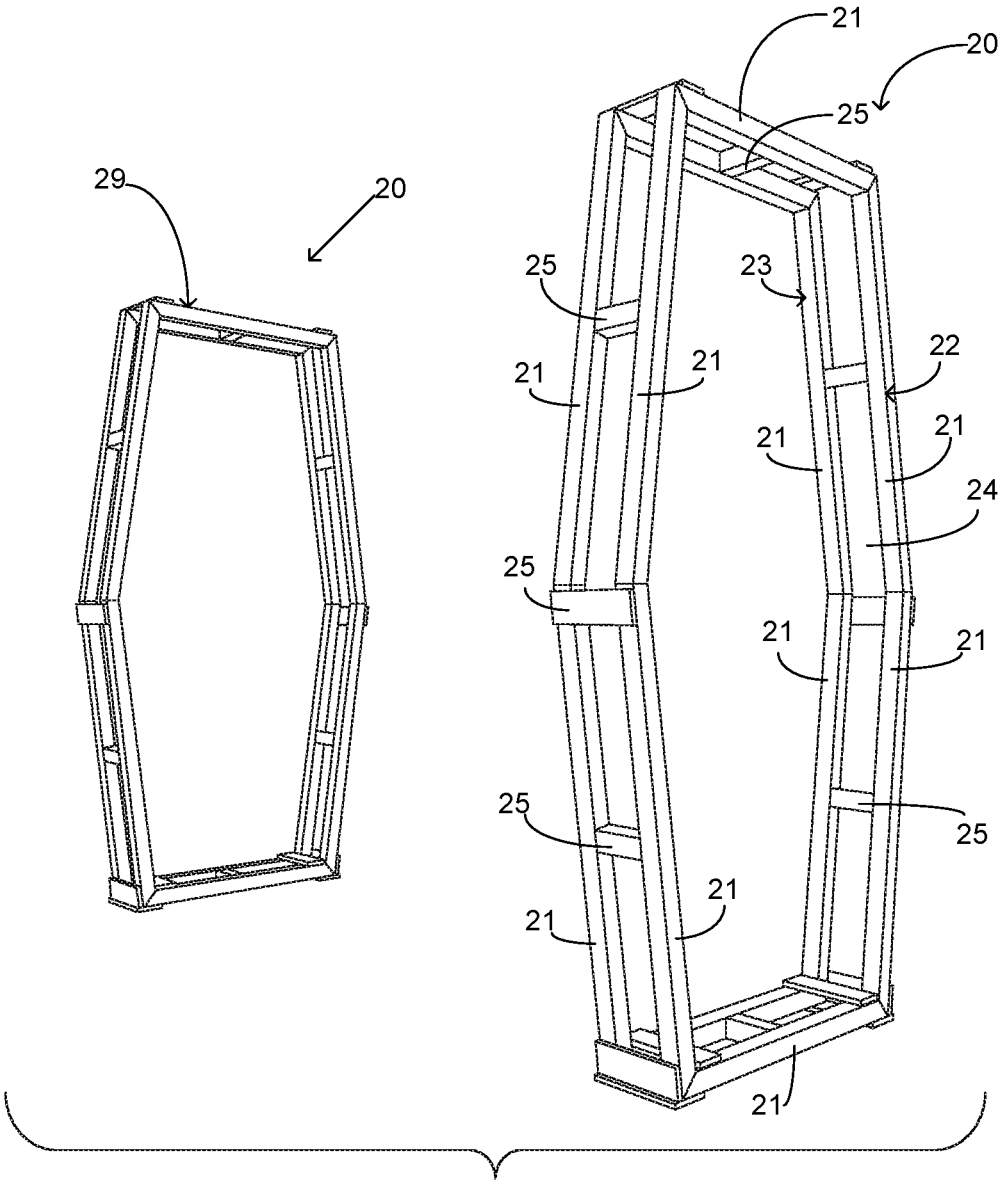
FIG. 3 is a detailed view of two support members of the present invention.
Figure 4:
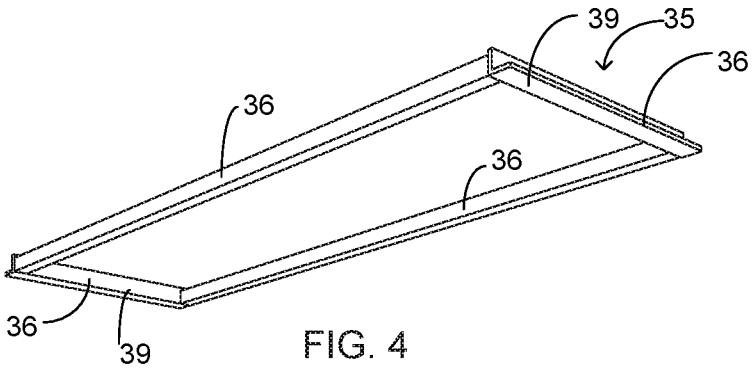
FIG. 4 is a detailed view of the top frame member of the present invention.
Figure 5:
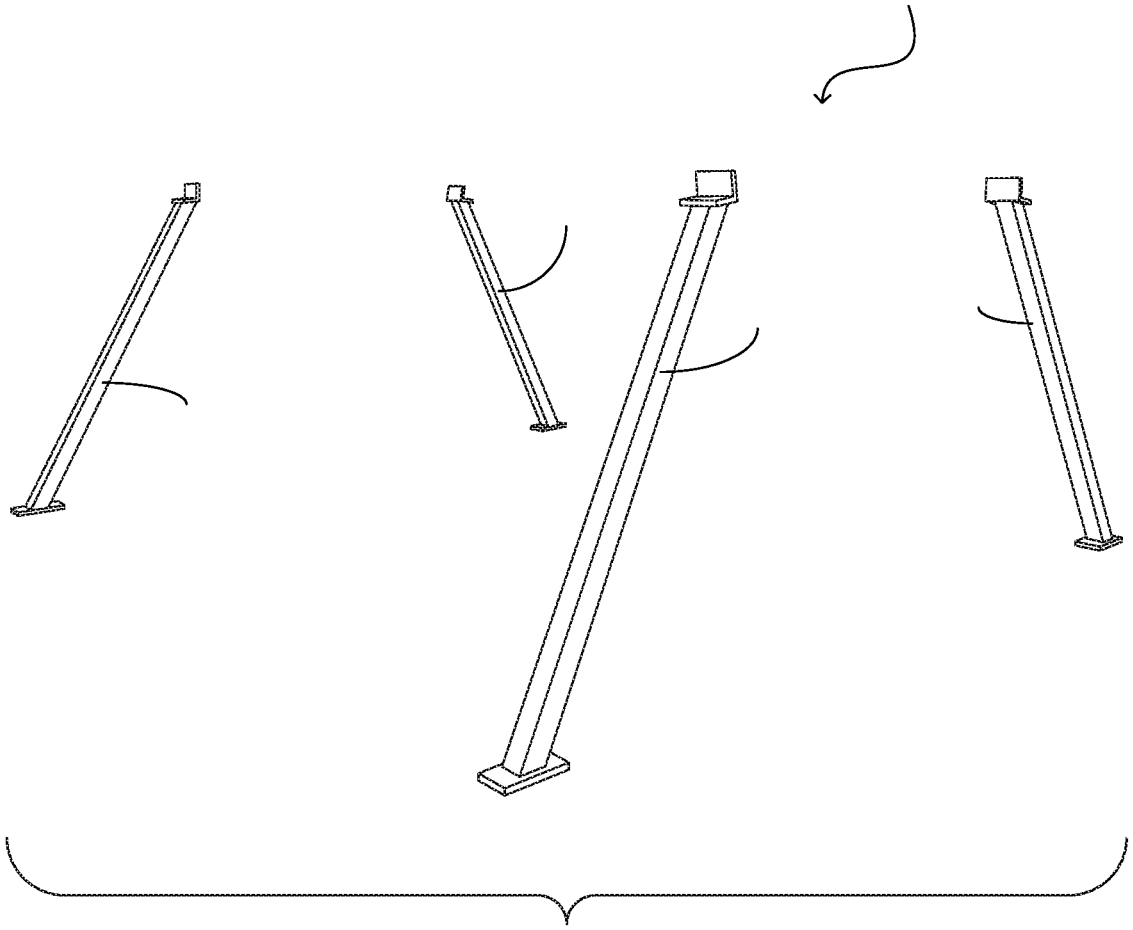
FIG. 5 is a detailed view of the angular support members of the lateral stability component.
Figure 6:
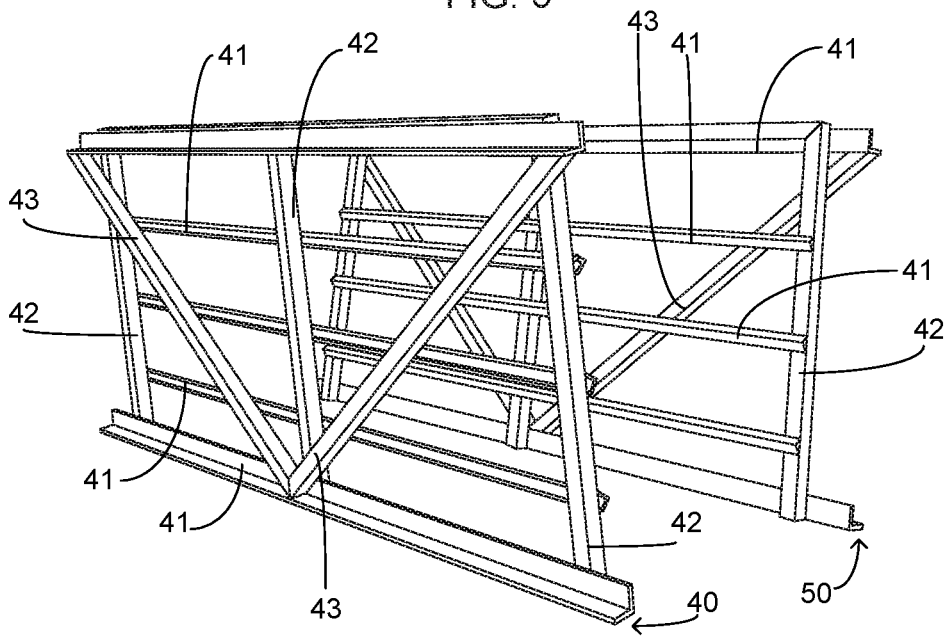
FIG. 6 is a detailed view of the side rails of the present invention.

References now to the drawings submitted herewith, wherein various elements depicted therein are not necessarily drawn to scale and wherein through the views and figures like elements are referenced with identical reference numerals, there is illustrated a modular bridge system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring now to the drawings submitted herewith, the modular bridge system 100 includes a deck member 10. The deck member 10 is manufactured from a lightweight rigid material such as but not limited to aluminum. The deck member 10 is rectangular in shape and in a preferred embodiment is approximately eight feet in length. It should be understood within the scope of the present invention that the deck member 10 could be provided in alternate lengths but it is intended within the scope of the present invention that the modular bridge system 100 is able to be disassembled and transported within a conventional pickup truck bed or small trailer of equivalent size. The deck member 10 includes an upper surface 11 that is non-skid material. It is contemplated within the scope of the present invention that the upper surface 11 could be manufactured from alternate non-skid materials.

The deck member 10 is manufactured having a width that facilitates the ability for the deck member 10 to be operably engaged with the support members 20. The support members 20 are manufactured from a lightweight rigid material such as but not limited to aluminum. In a preferred embodiment the support members 20 are an elongated polygon in shape. The aforementioned shape and the structure of the support members 20 provides the desired structural load capabilities. While the support members 20 are illustrated and discussed herein in the preferred embodiment, it is contemplated within the scope of the present invention that the support members 20 could be provided in alternate shapes.

The support members 20 are comprised of a plurality of structural members 21 that are arranged and secured to form the aforementioned elongated polygon shape. The structural members 21 are present in a first set 22 and a second set 23 wherein the first set 22 and second set 23 are adjacent to each other having a void 24 therebetween. A plurality of connection members 25 are intermediate the first set 22 and second set 23 of structural members 21 and perpendicular therewith. The connection members 25 are operably coupled to the first set 22 and second set 23 of the structural members 21 utilizing suitable techniques such as but not limited to welding. The modular bridge system 100 includes at least two upper members 20 once completely assembled. It should be understood within the scope of the present invention that the modular bridge system 100 could employ alternate quantities of the support members 20 depending upon the length of the modular bridge system 100 or during deployment of multiple modular bridge systems 100 operably coupled to extend a longer span.

A top frame support member 35 is superposed the support members 20 opposite the deck member 10 and functions to provide additional structural support for the modular bridge system 100 once assembled. The top frame support member 35 is manufactured from a rigid lightweight material such as but not limited to aluminum and is rectangular in shape. The top frame support member 35 is comprised of four support beams 36 that are secured to create the desired rectangular shape so as to be operably coupled to the top portion 29 of the support members 20. It should be understood within the scope of the present invention that the top frame support member 35 could be provided in alternate sizes so as to be positioned on top of the support members 20 wherein the end beams 39 of the top frame support member 35 are in alignment with the support members 20 in order to be releasably secured thereto.

The modular bridge system 100 further includes a first side panel 40 and a second side panel 50. The first side panel 40 and second side panel 50 are operably secured to opposing sides of the support members 20 ensuing installation of the modular bridge system 100 in order to provide a laterally positioned safety rail. The first side panel 40 and second side panel 50 are manufactured from a lightweight rigid material such as but not limited to aluminum. The first side panel 40 and second side panel 50 include a plurality of horizontal support members 41 and vertical support members 42 that are operably coupled utilizing suitable durable techniques. The first side panel 40 and second side panel 50 further include transverse support members 43 wherein the transverse support members 43 are diagonally secured on the first side panel 40 and second side panel 50. It should be understood within the scope of the present invention that the first side panel 40 and second side panel 50 could be comprised of alternate quantities of horizontal support members 41, vertical support members 42 and transverse support members 43.

The modular bridge system 100 further includes a lateral stability component 60 that is configured to provide additional lateral stability in areas of uneven terrain wherein the modular bridge system 100 may be installed an requires the lateral stability component 60 in order to engage the surrounding terrain in an efficient manner to provide a stabile installation of the modular bridge system 100. The lateral stability component comprises a first base member 61 and a second base member 62. The first base member 61 and second base member 62 are elongated in form and manufactured from a lightweight rigid material such as but not limited to aluminum. The first base member 61 and second base member 62 are operably coupled to the bottom of the support members 20 having portions extending outward from opposing sides thereof. Angular support members 64 are positioned in between ends 68 of the first base member 61, second base member 62 and the support member 20 in order to provide the desired structural support. Additional angular support members 66 are positioned in between ends 68 of the first base member 61, second base member 62 and the support member 20. It should be understood within the scope of the present invention that the lateral stability component may or may not be required for installation of the modular bridge system 100 and is dependent upon the terrain. It is further contemplated within the scope of the present invention that the first base member 61 and second base member 62 could be configured to float so as to enable the modular bridge system 100 to be utilized in aquatic environments.

Figure 7:
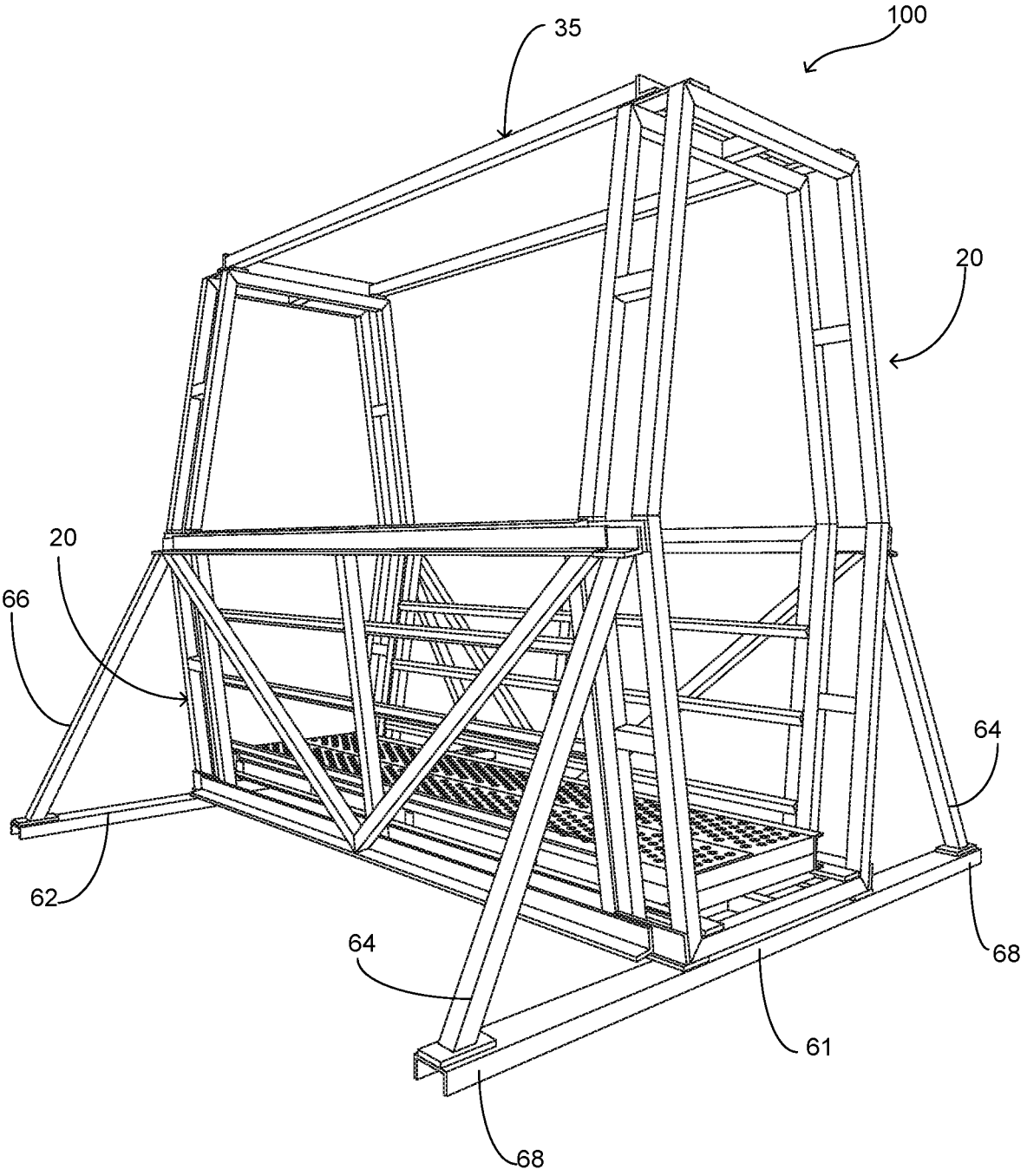
FIG. 7 is a perspective view of the assembled present invention.

It should be understood within the scope of the present invention that the components of the modular bridge system 100 described herein are configured to be releasably secured utilizing conventional fasteners such as but not limited to bolts and nuts. In a preferred embodiment of the modular bridge system 100 the components are configured with pre-drilled holes that will align upon placement of the components in the correct location so as to facilitate the ability to operably couple utilizing fasteners. It should be further understood within the scope of the present invention that the modular bridge system 100 could be configured to support various dynamic loads with minimal deflection and sway. By way of example but not limitation, a preferred twenty four foot embodiment could support a twenty seven hundred pound live dynamic load with minimal deflection and sway. It is additionally contemplated within the scope of the present invention that the modular bridge system 100 could support various traffic in addition to human traffic thereon such as but not limited to various motorized vehicles. Furthermore, while a single assembled modular bridge system 100 is illustrated herein in FIG. 7, it is within the scope of the present invention that multiple assembled modules could be linked together to span a desired distance.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the claims.

What is claimed is:

1. A portable bridge system that is configured to be transportable so as to facilitate installation in a location wherein the portable bridge system comprises:

a deck member, said deck member being rigid and rectangular in shape, said deck member having a first end and a second end, said deck member having an upper surface, said upper surface of said deck member configured to have humans traverse thereacross;

at least two support members, wherein said at least two support members are located at opposing ends of said deck member, said at least two support members being comprised of a plurality of structural members, said plurality of structural members formed to create the at least two support members, said at least two support members have an opening, said opening of said at least two support members being of suitable size to allow an upright human being traverse therethrough, said at least two support members having a bottom portion and an upper portion, said deck member being releasably secured to the bottom portion of the at least two support members;

a top frame member, said top frame member being superposed the upper portion of said at least two support members, said top frame member configured to structurally couple the upper portion of the at least two support members so as to provide in combination with the deck member a rigid structural assembly of the portable bridge system; and a pair of side panels, said pair of side panels being mounted to opposing sides of the at least two support members, said pair of side panels extending between the at least two support members, said pair of side panels being located proximate the bottom portion of the at least two support members, wherein the pair of side panels further include a plurality of vertical support members and a plurality of horizontal support members structurally coupled to create the pair of side panels.

2. The portable bridge system as recited in claim 1, wherein the plurality of structural members of the at least two support members are provided in a first set and a second set, wherein the first set and second set are adjacent and have a void therebetween.

3. The portable bridge system as recited in claim 2, wherein the at least two support members include a plurality of connection members, said plurality of connection members intermediate the first set and second set and configured to operably couple the first set and second set.

4. The portable bridge system as recited in claim 3, wherein the at least two support members are elongated polygon in shape.

5. The portable bridge system as recited in claim 4, and further including a lateral stability component, said lateral stability component having at least two base members, said at least two base members having portions extending outward from opposing sides of the at least two support members.

6. The portable bridge system as recited in claim 5, wherein the lateral stability component further includes a plurality of angular support members operably coupled to the at least two base members and the at least two support members.

7. A portable modular bridge system that is configured to transportable to a location for temporary installation wherein the portable modular bridge system comprises:

a deck member, said deck member being rigid and rectangular in shape, said deck member having a first end and a second end, said deck member having an upper surface, said upper surface of said deck member configured to have humans traverse thereacross;

two support members, wherein said two support members are located at opposing ends of said deck member, said two support members having an opening configured to permit a human to traverse therethrough, said two support members being comprised of a first set of structural members and a second set of structural members, said first set of structural members and said second set of structural members being adjacent and having a void therebetween, said two support member having a plurality of connection members, said connection members being intermediate said first set of structural members and said second set of structural members and configured to provide structural coupling thereof, said two support members having a bottom portion and an upper portion, said deck member being releasably secured to the bottom portion of the two support members;

a top frame member, said top frame member being superposed the upper portion of said two support members, said top frame member configured to structurally couple the upper portion of the two support members so as to provide in combination with the deck member a rigid structural assembly of the portable bridge system; and a pair of side panels, said pair of side panels being mounted to opposing sides of the two support members, said pair of side panels extending between the two support members, said pair of side panels being located proximate the bottom portion of the at least two support members, said pair of side panels having a plurality of horizontal support members and a plurality of vertical support members.

8. The portable modular bridge system as recited in claim 7, wherein the two support members are polygon in shape.

9. The portable modular bridge system as recited in claim 8, and further including a lateral stability component, said lateral stability component having two base members, said two base members being elongated in form, said two base members configured to be secured to the bottom portion of the two support members, said two base members having portions extending outward from opposing sides of the two support members.

10. The portable modular bridge system as recited in claim 9, wherein the lateral stability component further includes a plurality of angular support members operably coupled to the two base members and the two support members.

11. The portable modular bridge system as recited in claim 10, wherein the pair of side panels further include two transverse support members, said two transverse support members being diagonally secured to the pair of side panels.

12. The portable modular bridge system as recited in claim 11, wherein the upper surface of the deck member is non-skid.

* * * * *